US006250695B1

(12) United States Patent
Berkman

(10) Patent No.: US 6,250,695 B1
(45) Date of Patent: Jun. 26, 2001

(54) SCOOP

(75) Inventor: Samuel Berkman, Pt. Pleasant, NJ (US)

(73) Assignee: Nu-Tec Corp., Pt. Pleasant, NJ (US)

( * ) Notice: Subject to any disclaimer, the term of this patent is extended or adjusted under 35 U.S.C. 154(b) by 0 days.

(21) Appl. No.: 09/591,942

(22) Filed: Jun. 12, 2000

(51) Int. Cl.[7] ..... A01K 29/00; E01H 1/12
(52) U.S. Cl. ..... 294/1.3; 294/55
(58) Field of Search ..... 294/1.3, 25, 55; 15/104.8, 257.1; 206/223, 496, 577; 229/115, 116, 117.12

(56) References Cited

U.S. PATENT DOCUMENTS 3,995,807 * 12/1976 Dell'Anno ..... 294/1.3
4,251,097 * 2/1981 Whitten ..... 294/55 X
4,635,843 * 1/1987 Tomlinson ..... 294/551 X
4,715,495 * 12/1987 Henry ..... 294/1.3 X
4,809,390 * 3/1989 Jackson et al. ..... 294/1.3 X

FOREIGN PATENT DOCUMENTS

3542098 * 6/1987 (DE) ..... 294/1.3
2695147 * 3/1994 (FR) ..... 294/1.3
2258136 * 2/1993 (GB) ..... 294/1.3

* cited by examiner

*Primary Examiner*—Johnny D. Cherry
(74) *Attorney, Agent, or Firm*—Stephan Siegel

(57) ABSTRACT

A scoop for conveniently picking up waste, such as dog feces, is constructed from a single sheet of thin material and developed into a trough shape with a rearwardly directed handle. The scoop configuration is of a shape which allows a plurality of scoops to be nested together in a convenient package.

4 Claims, 5 Drawing Sheets

SCOOP

FIELD OF THE INVENTION

The invention relates to disposable scoops suitable for removal of dog feces.

BACKGROUND OF THE INVENTION

It has now come to pass that through either legal, ethical or moral requirements, disposal of dog feces in a clean and least unobtrusive manner is desirable. Apparatus which facilitates such fecal matter removal in a convenient manner is also desirable. Notwithstanding the aforesaid use, the subject invention is suitable for alternative similar uses such as the removal of vomit and other biological, or chemical disposables.

In the disposal of undesirable waste products, it is particularly desirable to isolate the offensive waste products from contact with the person performing the disposing process. In addition, the devices used to remove the waste may become soiled or contaminated posing an unsanitary condition in and of itself. It is therefore of particular importance to have the ability to obtain an inexpensive, disposable receptacle which effectively isolates the receptacle's contents from the hand of the user.

In the manufacturing process of a disposable scoop, it is desirable to utilize the least material and create the least material waste. By eliminating material waste, a manufacturing cost is eliminated making the product less expensive to manufacture. It is additionally desirable to fabricate a product which may be nested together, one inside another, which in turn facilitates transportation and storage of the product in desirable quantities.

SUMMARY OF INVENTION

It is an object of the invention to provide an implement which can easily and effectively scoop waste matter, such as dog feces and do so without the need for an additional aid such as a paddle.

It is also an object of the invention to create a scoop having geometry which will effectively hold waste contents in a manner least likely to contact the hands of the user.

It is still further an object of the invention to form such implement in a cost effective manner from a single sheet of material while leaving the least amount of material waste.

The invention is developed from a single sheet of substantially rectangular material, such as cardboard, by folding along pre-depressed fold lines to form a substantially rectangular shaped trough. A rear portion of the trough formed from the resulting folds is then fastened together by means of a staple or adhesive. Fractured portions of the rear wall of the trough are folded rearwardly to form handles to manipulate the invention.

The resulting configuration produces a device in the form of a scoop having side and rear walls. Integrally formed handles are angled to facilitate a downward force component on the front of the scoop to assist in gathering waste products.

Additional objects and features of the invention will be evident from the following description taken in conjunction with the accompanying drawings.

DESCRIPTION OF THE PREFERRED EMBODIMENT

Figure 1:
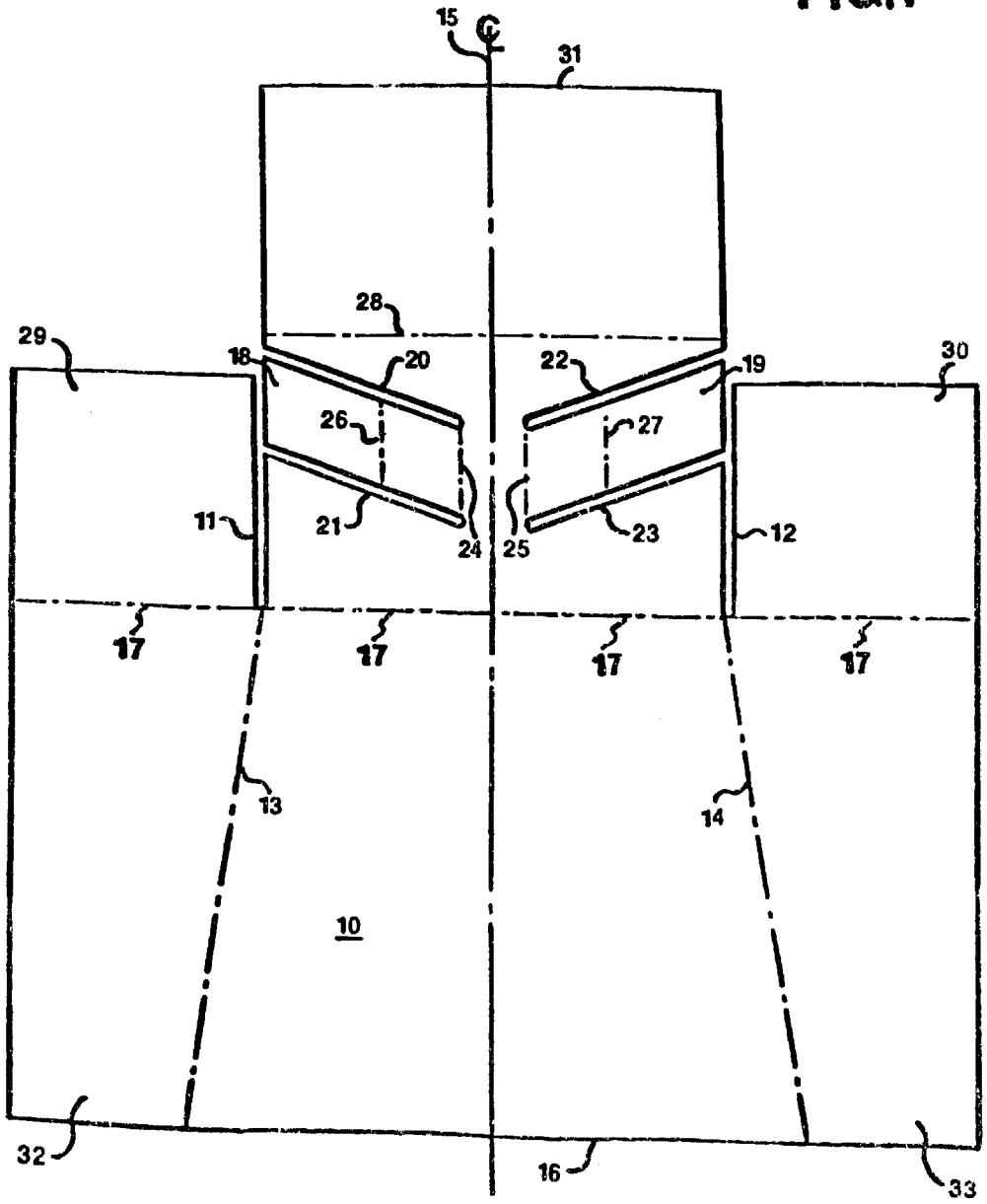
FIG. 1 is a plan view of a blank showing slits and fold lines, developable into a scoop.
Figure 1A:
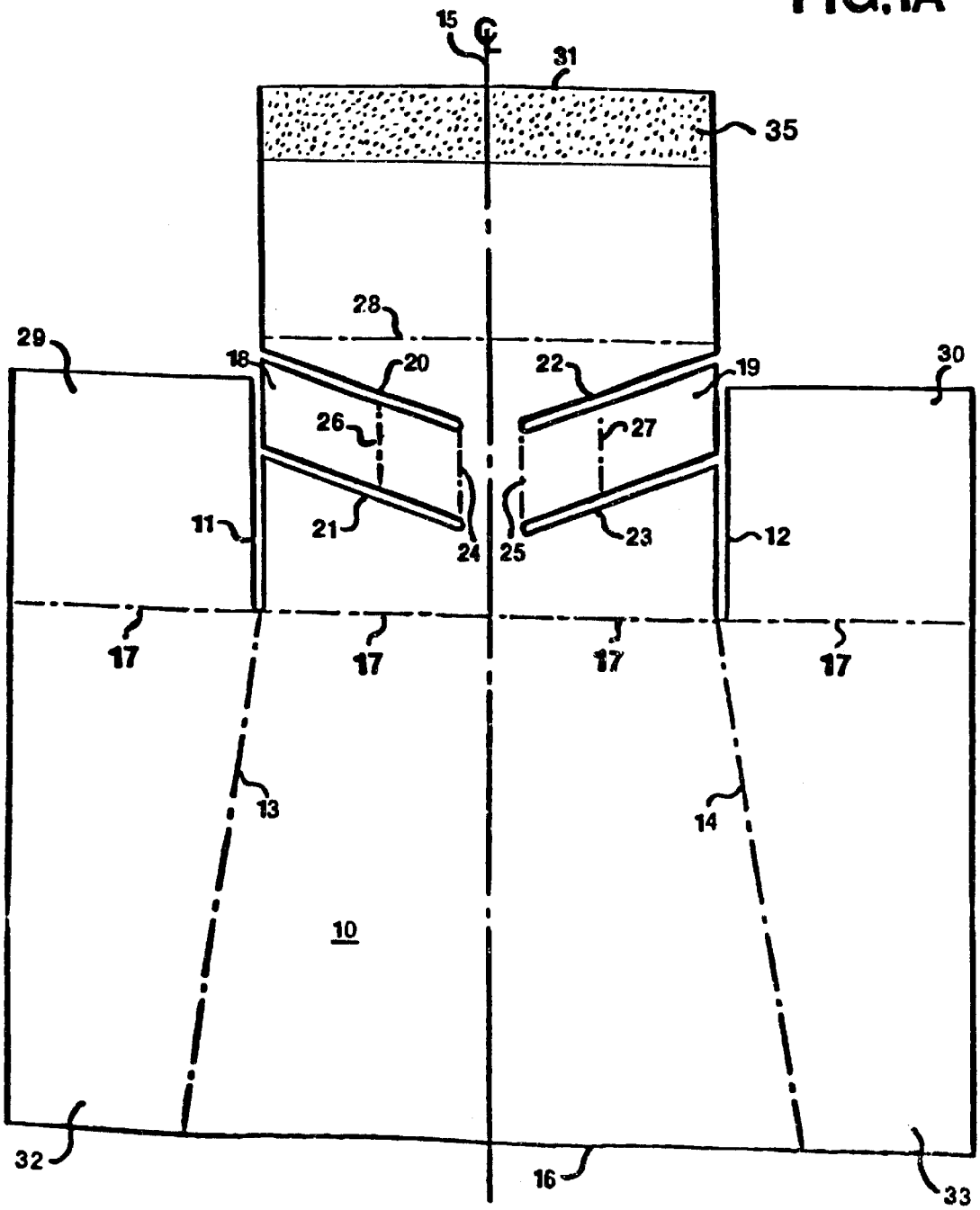
FIG. 1A is a plan view of a blank showing the location of adhesive material.

With reference to FIG. 1, a thin rectangular blank 10, preferably formed of a corrugated cardboard material, embodies the invention. Blank 10 incorporates slits 11 and 12 and respective fold lines 13 and 14. Said fold lines extend from the terminus of respective slits 11 and 12 to side 16. A third fold line 17 extends from opposite sides of blank 10 through the terminus of respective slits 11 and 12 forming substantially rectangular tabs 29 and 30. Handles 18 and 19 are formed from the resulting blank portions created by respective Slits 20 and 21 and slits 22 and 23. Fold lines 24 and 25 respectively form the junction about which handles 18 and 19 are folded. Additional fold lines 26 and 27 located along respective handles 18 and 19 permit the outermost portion of handles 18 and 19 to be joined together. A fold line 28, located above handles 18 and 19, forms a border of resulting tab 31.

Figure 2:
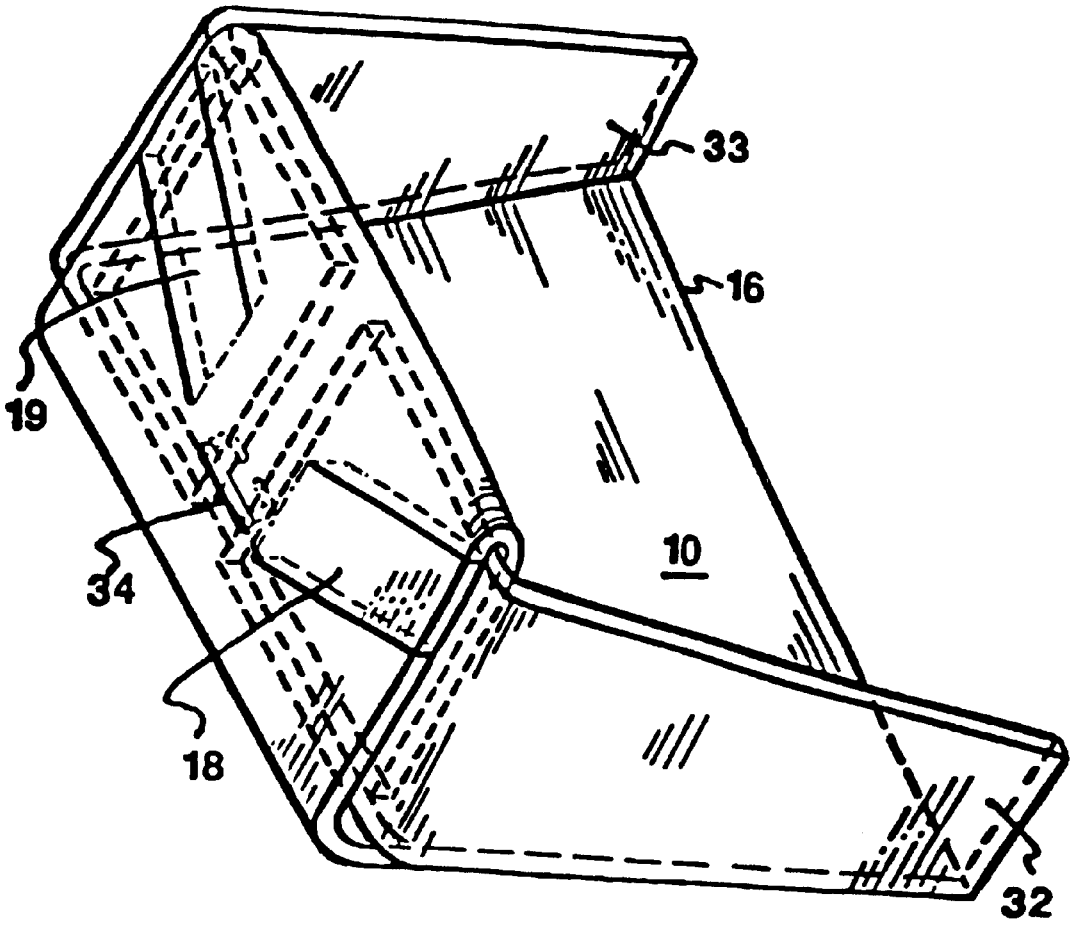
FIG. 2 is a perspective view of the invention prior to the deployment of the integrated handles.

With reference to FIG. 2, sides 32 and 33 are erected along respective fold lines 13 and 14. Tabs 29 and 30 are folded along associated portions of fold line 17 to substantially right angles with respective sides 32 and 33. Blank 10 is thereafter folded along the remaining portion of fold line 17 at substantially right angles forming a three sided trough. Tab 31 is folded along fold line 28 over tabs 29 and 30.

Figure 3:
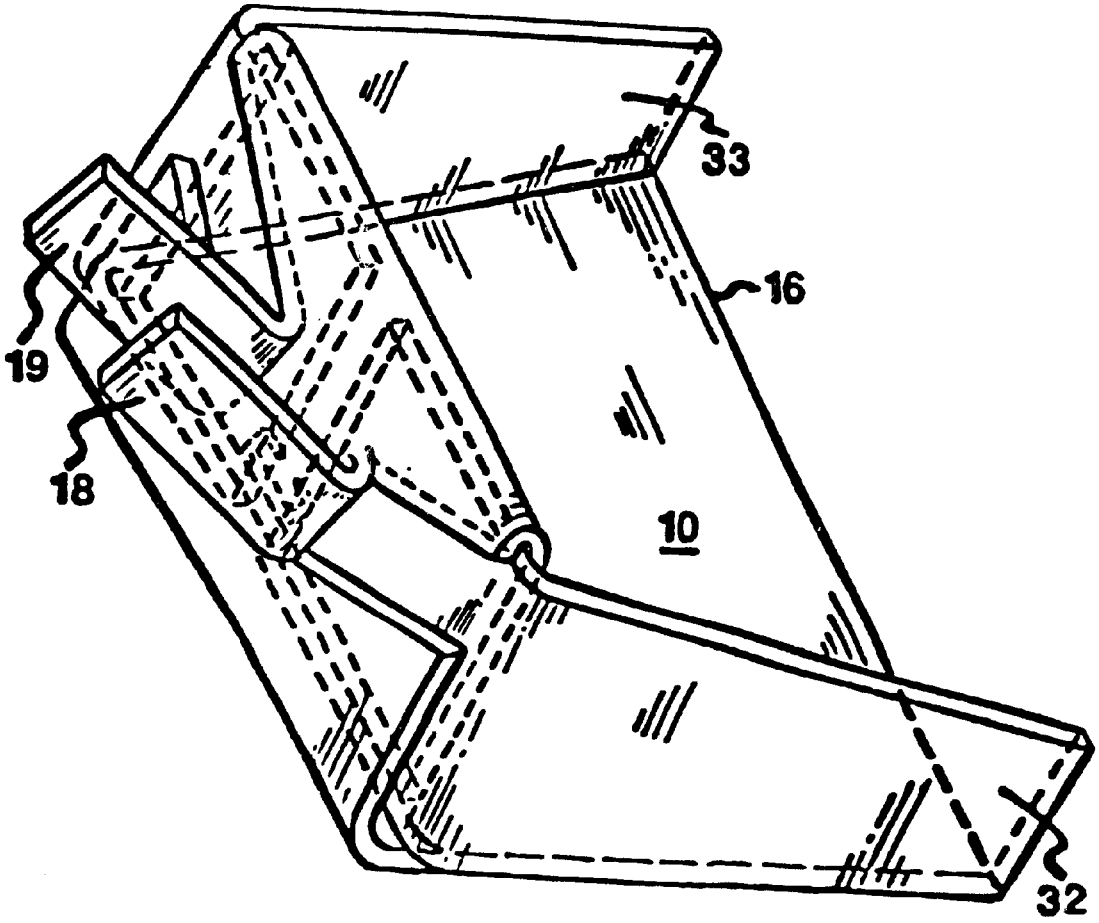
FIG. 3 is a perspective view of the invention with the integrated handles partially deployed.
Figure 4:
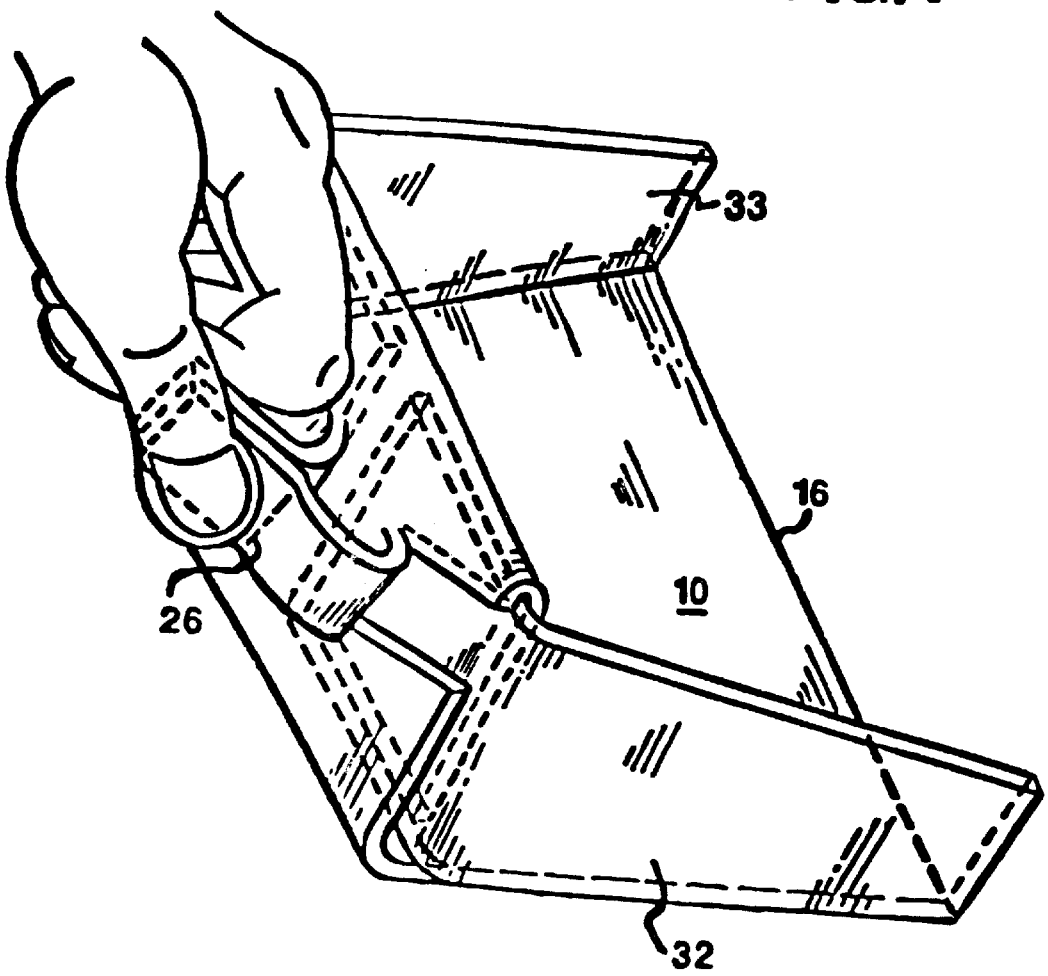
FIG. 4 is a perspective view of the invention with the integrated handles fully deployed.

With reference to FIG. 3, handles 18 and 19 are folded rearwardly along respective fold lines 24 and 25. A portion of the aforesaid handles are brought into intimate touching relationship by folding along respective fold lines 26 and 27 as depicted in FIG. 4.

DETAILED DESCRIPTION OF THE PREFERRED EMBODIMENT

As shown in FIG. 1, a symmetrically shaped blank 10 of corrugated cardboard or other similar material having fold lines 13 and 14 is formed into a substantially rectangular trough by first folding the outermost portions of blank 10 along said fold lines, inwardly and to right angles to form sides 32 and 33 (FIG. 2). Thereafter, tabs 29 and 30 are each folded along associated portions of fold line 17, at substantially right angles to respective sides 32 and 33. The rear portion of blank 10 is then folded to a substantially right angle along the remaining portion of fold line 17. Tab 31 is then folded along fold line 28 over tabs 29 and 30 and fastened to the adjacent portion of blank 10. One preferable means of fastening tab 31 is through the use of a staple 34 as shown in FIG. 2. Although a staple is used as the fastening device, other fastening means such as adhesive 35 can be used.

Handles 18 and 19 are deployed from blank 10 by folding along respective fold lines 24 and 25 to substantially 90 degree angles from their initial position, rearwardly, in opposite directions, to form the means by which the scoop is preferably held. Portions of handles 18 and 19 are placed in touching relationship by folding respective ones of these handles along fold lines 26 and 27. Handles 18 and 19 are angularly disposed with respect to the base of the resultant rectangular trough facilitating a downward force to rectangular base edge 16. When the resultant scoop is moved forward along the plane in which the disposable matter is located, the downward force on the forward edge of the scoop aids in the capture of waste material. The waste matter captured in the scoop is then kept away from the operator's hand by virtue of the vertically disposed rear wall of the scoop formed by folded side 31 which forms an angle of approximately 90 degrees with the base of the scoop.

To facilitate transportation and packaging of the scoop, a large plurality of scoops may be nested together one in the other. In this manner, a minimum of space will be utilized for their packaging and transport.

I claim:

1. A scoop, suitable for debris collection and disposal, comprising: a single blank of uniform thickness incorporating fold lines extending from an edge of said blank; two substantially parallel perimeter sides formed along respective ones of said fold lines; a fold line perpendicular to said parallel perimeter sides; a third perimeter side formed along said last mentioned fold line; first and second substantially rectangular tabs extending along respective ones of said parallel sides; fold lines defining a side of each of said tabs about which said tabs are folded into the plane of said third perimeter side; a third tab extending from said third perimeter side; a fold line defining a side of said third tab about which said third tab is folded substantially one hundred and eighty degrees over said first and second tabs; means for coupling said third tab to said third perimeter side; first and second pairs of substantially parallel slits, symmetrically disposed in said third perimeter side; and first and second handles extending from the regions defined, respectively, by said first and second pairs of substantially parallel slits.

2. A scoop according to claim 1 wherein said coupling means comprises an adhesive interposed between adjacent portions of said third perimeter side and said third tab.

3. A scoop according to claim 1 wherein said coupling means comprises a staple, portions of which pass from one portion of said third perimeter side to an adjacent portion on said third tab.

4. A scoop according to claim 1 wherein said first and second handles each include a perpendicularly disposed fold line allowing portions of said handles to be placed in intimate touching relationship.

* * * * *